US005454735A

United States Patent [19]

Nelson

[11] Patent Number: 5,454,735

[45] Date of Patent: Oct. 3, 1995

[54] SEVERABLE RADIO FREQUENCY COAXIAL CABLE CONNECTORS HAVING MINIMAL SIGNAL DEGRADATION

[75] Inventor: James W. Nelson, Cheshire, Conn.

[73] Assignee: Radio Frequency Systems, Inc., North Haven, Conn.

[21] Appl. No.: 229,912

[22] Filed: Apr. 19, 1994

[51] Int. Cl.[6] ..... H01R 9/07

[52] U.S. Cl. ..... 439/578; 439/607; 439/840

[58] Field of Search ..... 439/349, 824, 439/825, 675, 578–585, 840, 841, 607–610

[56] References Cited

U.S. PATENT DOCUMENTS

| | | | |
|---|---|---|---|
| 3,297,895 | 12/1966 | Van Dyke | 439/578 |
| 3,793,610 | 2/1974 | Brishka | 439/349 |
| 4,810,213 | 3/1989 | Chabot | 439/825 |
| 4,963,105 | 10/1990 | Lewis et al. | 439/578 |
| 5,137,470 | 8/1992 | Doles | 439/578 |

*Primary Examiner*—David Pirlot

*Attorney, Agent, or Firm*—Ware, Fressola, Van Der Sluys & Adolphson

[57] ABSTRACT

Male and female radio frequency cable connectors 64 and 13 have corresponding circumferential grooves 80 and 44 which are aligned and face each other when the connectors 64 and 13 are in a connected state so as to form a channel. The connectors 64 and 13 are held together by a canted-coil spring 11 residing in the channel formed by the two aligned and facing circumferential grooves 80 and 44. Deformation of the canted-coil spring 11 residing in the channel allows the male and female counterpart RF cable connectors 64 and 13 to resist separation as well as provide a primary electrical contact between the two connectors. If a substantial tensile force is placed on the cables 12 and 85, the spring 11 will deform sufficiently to allow separation of the two connectors 64 and 13.

4 Claims, 4 Drawing Sheets

FIG. 6B
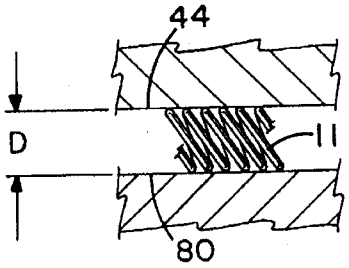
FIG. 7A
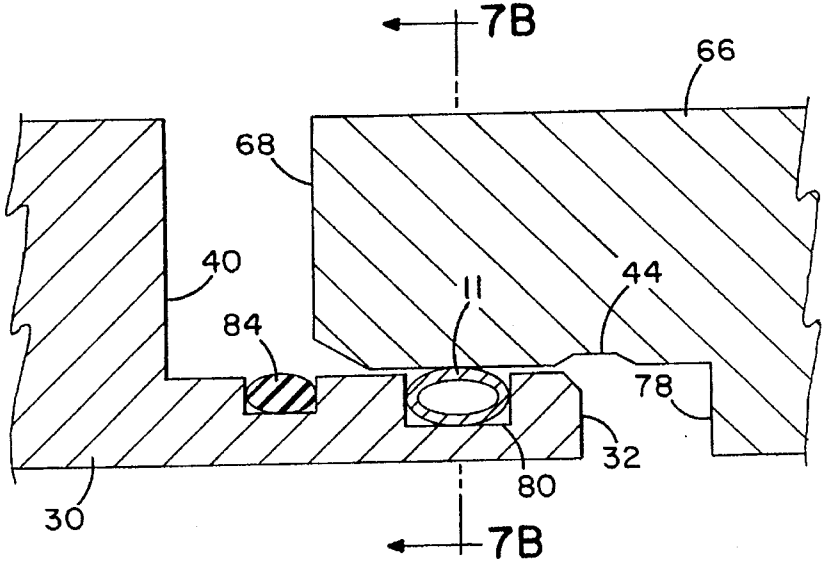
FIG. 6A
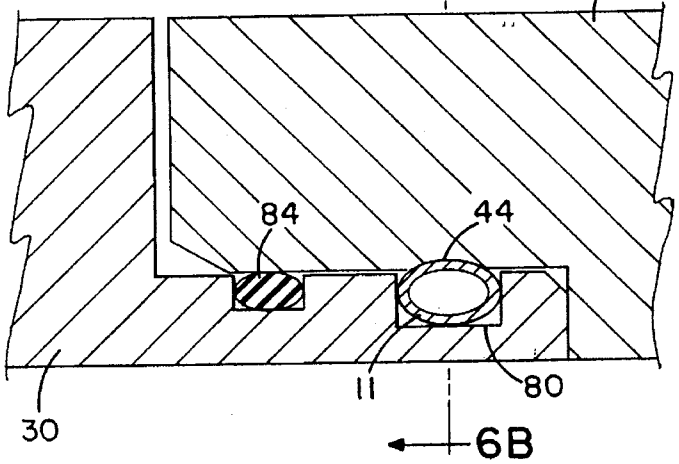
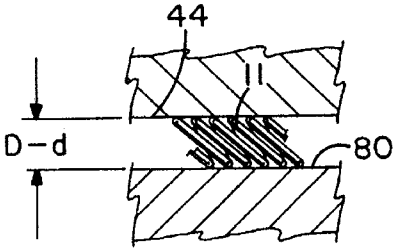
FIG. 7B

SEVERABLE RADIO FREQUENCY COAXIAL CABLE CONNECTORS HAVING MINIMAL SIGNAL DEGRADATION

BACKGROUND OF THE INVENTION

1. Field of the Invention

The present invention generally relates to radio frequency (RF) coaxial cable connectors, and more particularly, to a pair of connectors for joining two RF cables that readily separate when the RF cables are subjected to a tensile force above a predetermined limit. The connectors may be reconnected after separation and, when connected, cause only minimal degradation to the RF signal passing therethrough.

2. Description of the Prior Art

In many applications of RF coaxial cables it is desirable to provide cables that include one or more weakened points or "weak links" along the cable for safety purposes. One example of such an application is the use of RF coaxial cables in antenna scaffolding located near airport runways because such scaffolding is at risk of being hit by all or part of an errant airplane. Antenna scaffolding is usually designed with weak links so that upon impact the scaffolding will break apart into smaller sections. However, if an RF coaxial cable that does not have any predetermined weak links is connected to the antenna on the scaffolding, there may be a tendency for the cable to prevent the scaffolding from breaking apart according to its intended design because the cable effectively ties the scaffolding together. This "tieing" problem could cause damage or, in some cases, greater damage to the errant airplane or injury to passenger's therein.

A prior art solution to the "tieing" problem is to provide a cable having reduced cross-sectional areas at various points along its length. While the reduced cross-sectional areas provides a "weak link" and, thus, a solution to the "tieing" problem, the reduced cross-sectional area also causes a degraded RF signal. Also, this type of "weak link" has further drawbacks in that it is not easily reconnectable if severed.

Therefore, it is desirable to provide RF coaxial cable connectors that form reconnectable "weak links" without substantially degrading the RF signal quality of the coaxial cable.

SUMMARY OF THE INVENTION

Accordingly, it is one object of the present invention to provide an RF coaxial cable connector that is a reconnectable "weak link" with minimal RF signal degradation for an RF coaxial cable. This object is accomplished, at least in part, by the provision of male and female counterpart RF cable connectors. The connectors have corresponding circumferential grooves which are aligned and face each other when the connectors are placed in a connected state so as to form a channel. The connectors are held together, in part, by a canted-coil spring residing in the channel formed by the two aligned and facing circumferential grooves. Slight deformation of the canted-coil spring residing in the channel allows the male and female counterpart RF cable connectors to resist separation. However, a substantial tensile force sufficient to cause severe deformation of the spring will allow separation of the two cables. The canted coil spring also provides primary electrical contact between the male and female counterpart connectors.

Other objects and advantages of the present invention will become apparent to those skilled in the art from the following detailed description read in conjunction with the attached drawings and claims appended hereto.

BRIEF DESCRIPTION OF THE DRAWINGS

The drawings, not drawn to scale, include:

FIG. 6*a* which is a partial cross-sectional view of the male and female connectors of the present invention illustrating the canted-coil spring in a substantially free position residing in the channel formed by the circumferential grooves when the connectors are in a connected state;

FIG. 6*b* which is a cross-sectional view of the canted-coil spring in a substantially free position as shown in FIG. 6*a* taken along the line 6*b;*

FIG. 7*a* which is a cross-sectional view of the male and female connectors of the present invention illustrating the canted-coil spring in a deformed or loaded position residing in the groove of the female connector during the time when the male and female connectors are being joined or separated; and FIG. 7*b* which is a cross-sectional view of the deformed canted-coil spring as shown in FIG. 7*a* taken along the line 7*b*.

DETAILED DESCRIPTION OF THE INVENTION

Figure 1:
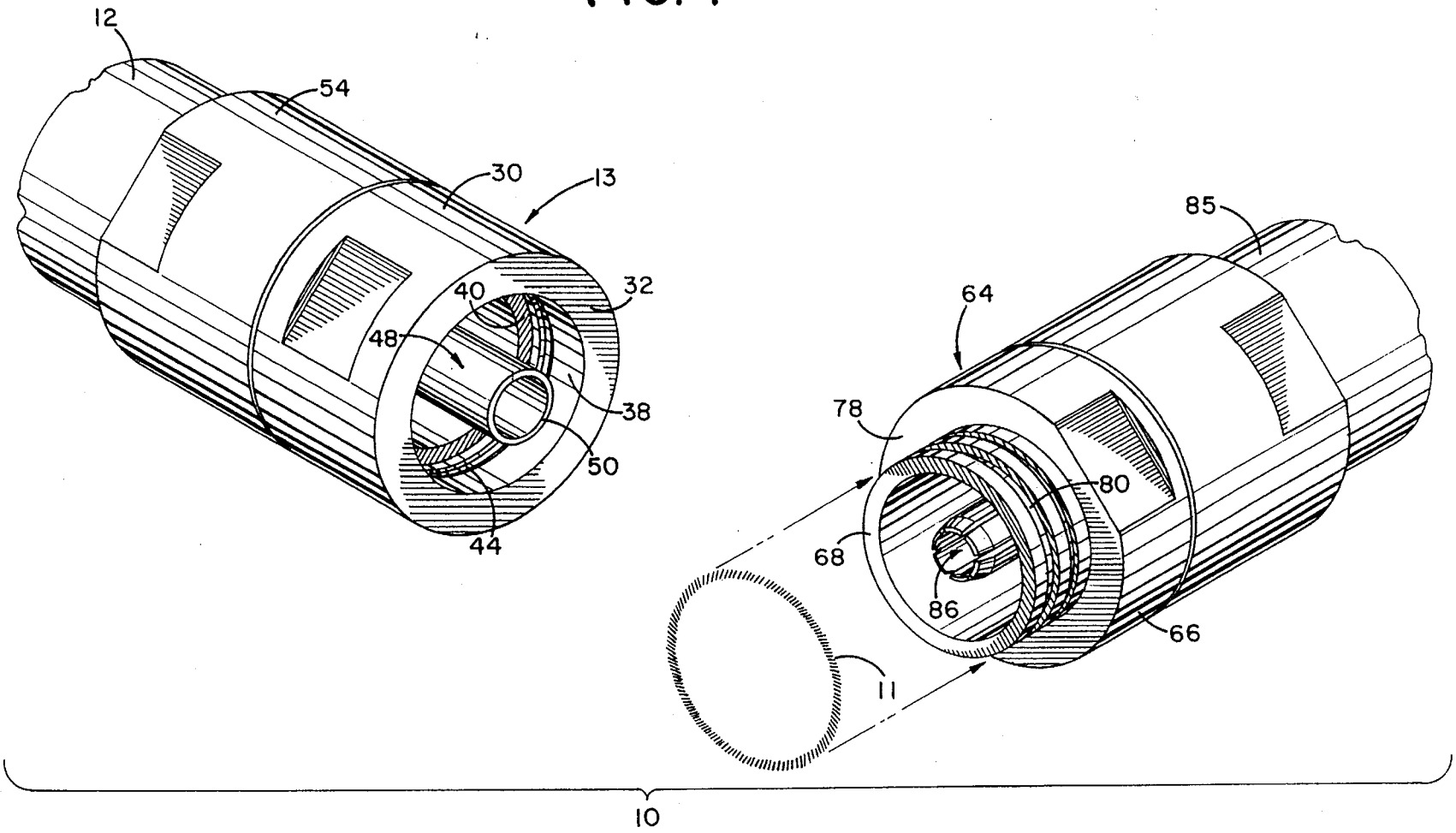
FIG. 1 which is a perspective view of the male and female coaxial cable connectors of the present invention and generally illustrates two disconnected radio frequency (RF) cables.

The severable radio frequency (RF) coaxial cable connectors of the present invention are used for connecting RF coaxial cables having non-helical ribbed outer conductors and helical ribbed inner conductors. The connectors, indicated at 10 in FIG. 1, generally include a female connector 13, a male connector 64 and a canted-coil wire spring 11 fitted between the female and male connectors. In the embodiment shown in FIG. 1, as in all contemplated embodiments of the present invention, ordinary tensile loads and vibrations will not loosen or separate the female 13 and male 64 connectors because the canted-coil wire spring 11 prevents the female 13 and male 64 connectors from becoming separated unless the cables are subjected to substantial tensile forces, such as those caused when an object strikes the cables.

Figure 3:
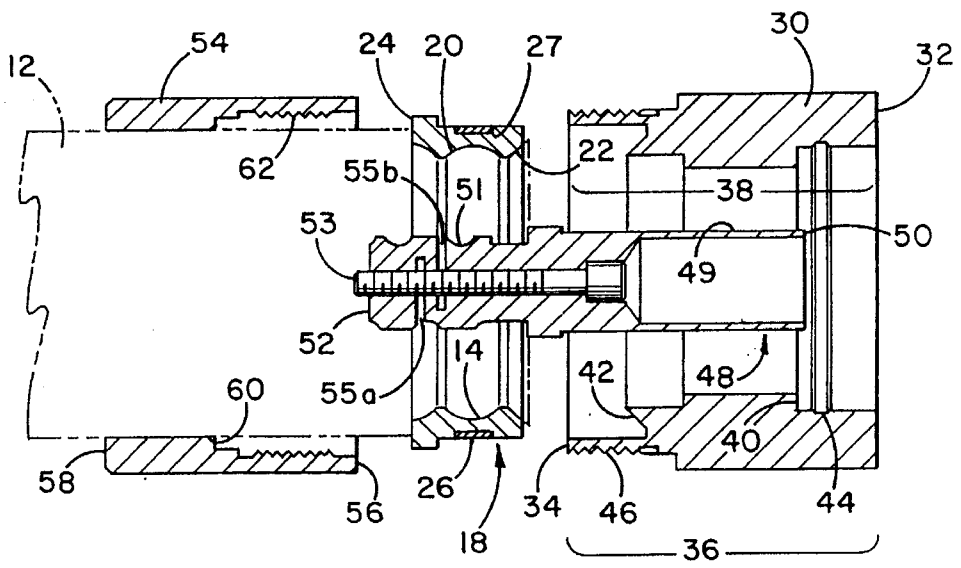
FIG. 3 which is a cross-sectional semi-exploded view of the end of a cable and a female connector illustrating the split ferrule, a union nut, a female outer conductor coupling and a female inner conductor coupling.
Figure 2:
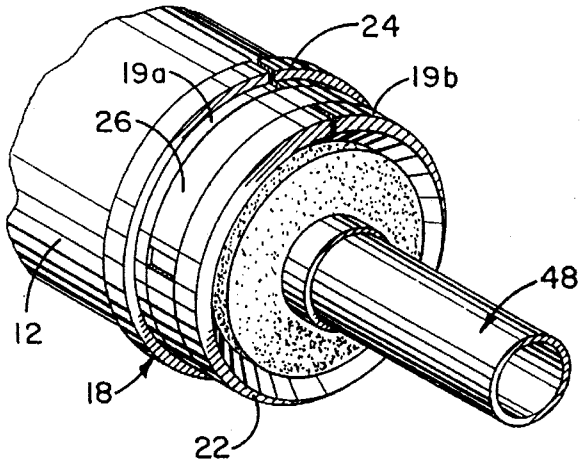
FIG. 2 which is a perspective view of the end of a cable illustrating two halves of a split ferrule held together by a clip and also illustrates an inner conductor coupling connected to the inner conductor of the cable.

FIGS. 2 and 3 illustrate a preferred embodiment for securing the male 64 and female 13 connectors to the RF coaxial cables. Referring to FIGS. 2 and 3, a coaxial cable 12 is shown with a split ferrule 18 attached thereto. The split ferrule 18 is formed by two semi-circular halves 19*a* and 19*b*. Both the semi-circular halves 19*a* and 19*b* include an interior surface 20 that substantially matches the shape of the non-helical ribbed outer conductor 14 of the RF coaxial cable 12. Both halves 19*a* and 19*b* also include a beveled first end 22 and an outwardly extending ranged second end 24. The semi-circular first and second halves 19*a* and 19*b* are held together by a clip 26 which fits in a circumferential recess 27 in the outer surface of the two halves 19*a* and 19*b*. As will be explained below the split ferrule 18 assists with the anchoring of the male and female connectors 64 and 13 to the cables.

FIGS. 2 and 3 also illustrate a female outer conductor coupling 30 that includes a first end 32, a second end 34, an exterior surface 36 and an interior surface 38. The interior surface 38 includes an interior flange 40 located adjacent to the first end 32, a beveled interior projection 42 located adjacent to the second end 34, and a circumferential groove 44 positioned between the interior flange 40 and the first end 32. The coupling 30 also has a threaded portion 46 on its exterior surface 40 adjacent to the second end 34.

FIG. 3 further illustrates a female inner conductor coupling 48 having a tubular portion 49 adjacent to a first end 50 and a threaded portion 51 extending to the second end 52. The threaded portion 51 may also include a pair of overlapping slots 55*a* and 55*b* and an axially positioned screw 53 extending transversely through the slots 55*a* and 55*b*. As will be appreciated by those skilled in the art, the screw 53 provides a clamping action to secure the threaded portion 51 to the helical ribbed inner conductor of the cable.

The preferred embodiment of the connector 13 also includes a union nut 54 that further includes a first end 56, a second end 58, and an interior surface that has an inwardly extending flange 60 and a threaded portion 62 adjacent to its first end 56. The second end 34 of the conductor coupling 30 is secured to the outer conductor 14 of the cable 12 by joining the threaded portion 62 of the union nut 54 with the threaded portion 46 of the outer conductor coupling 30 while the inwardly extending flange 60 is positioned adjacent to outwardly extending flanged second end 24 of the split ferrule 18 and while the beveled interior projection 42 of the female outer conductor coupling 30 is positioned adjacent to the complimentary beveled first end 22 of the split ferrule 18.

Figure 4B:
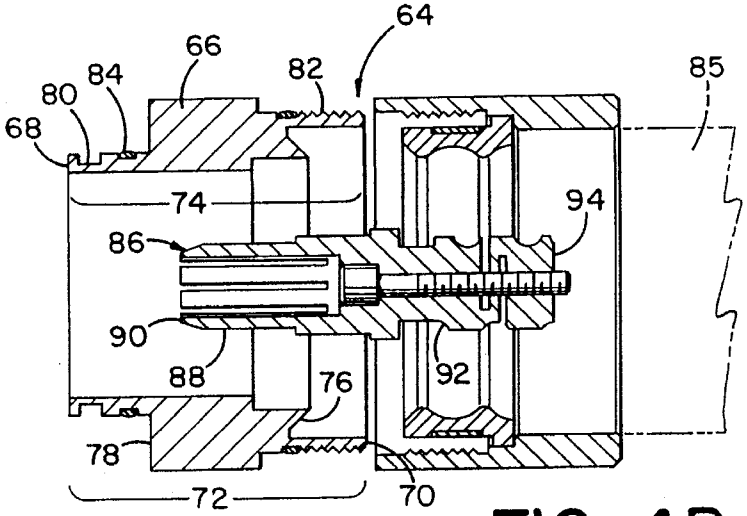
FIG. 4*b* which is a cross-sectional view of the male connector of the present invention.
Figure 4A:
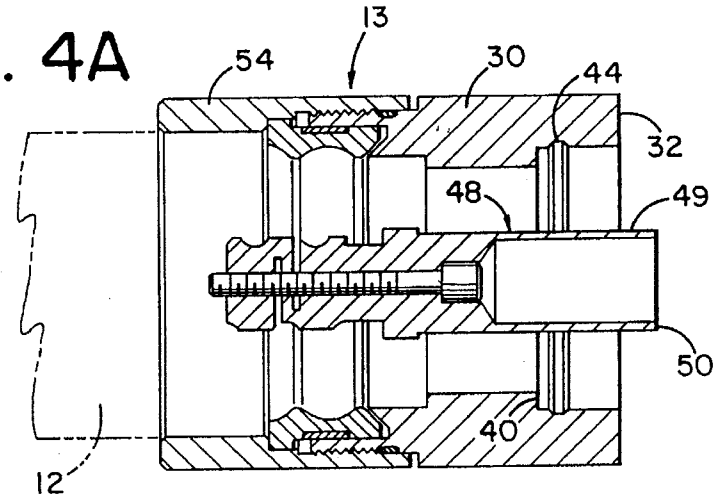
FIG. 4*a* which is a cross-sectional view of the female connector of the present invention.
Figure 5:
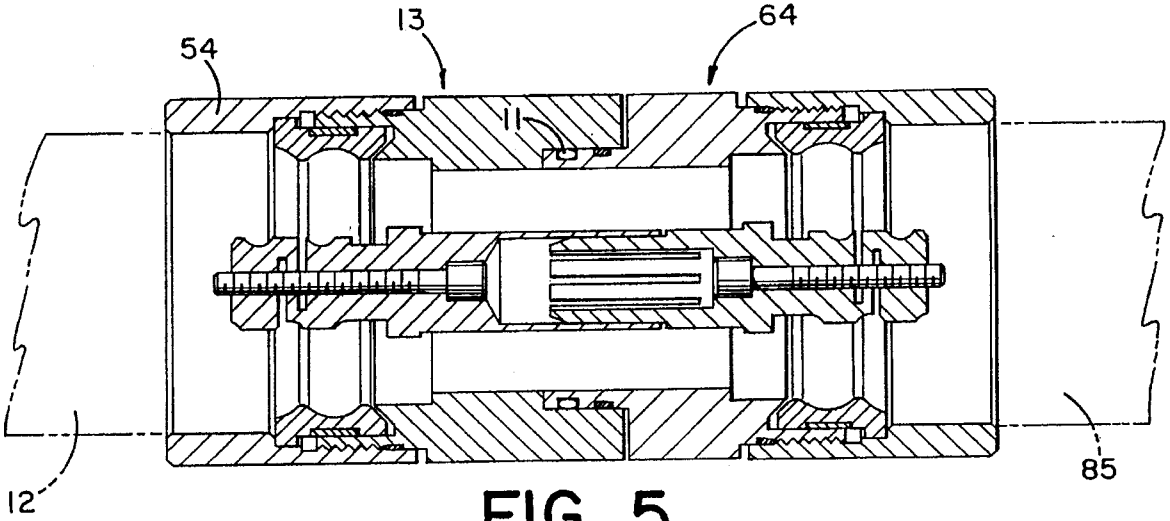
FIG. 5 which is a cross-sectional view of two cables connected by the male and female connectors of the present invention.

Referring now to FIG. 4*b*, the male connector 64 also includes a split ferrule and a union nut with features identical to that previously described for the split ferrule 18 and the union nut 54 of female connector 13. The male connector 64 further includes an outer conductor coupling 66 that has a first end 68, a second end 70, an exterior surface 72 and an interior surface 74. The interior surface 74 includes a beveled interior projection 76 adjacent to its second end 70 similar to the beveled interior projection of the female outer conductor coupling 30. The exterior surface 72 includes an exterior flange 78 adjacent to the first end 68, a circumferential groove 80 positioned between the exterior flange 78 and the first end 68, and a threaded portion 82 adjacent to the second end 70. As will be appreciated by those skilled in the art and as shown by FIGS. 5 and 6*a*, the actual position of the circumferential groove 80 is preferentially one that aligns the groove 80 with the circumferential groove 44 on the interior surface 38 of the female outer conductor coupling 30 to form a substantially enclosed channel when the female and male outer conductor couplings 30 and 66 are in a connected state. A second groove 84 may be positioned between the flange 78 and the circumferential groove 80 and an 0-ting may placed in the second groove 84 to form a weather tight seal for the connection between the male and female outer conductors 30 and 66. As shown in FIG. 5, the second end 70 of the male outer conductor coupling 66 is secured to the outer conductor of the RF cable 85 in exactly the same manner as that described for the female outer conductor coupling 30.

The male connector 64 also includes a male inner conductor coupling 86 having a semi-tubular portion 88 near a first end 90 and a threaded portion 92 near the second end 94. The semi-tubular portion 88 has a plurality of coaxial slots extending inwardly from the first end 90. The slots allow the semi-tubular portion 88 to be compressed inwardly when connected with the tubular portion 50 of the female inner conductor coupling 48. The male inner conductor coupling may also have an axially positioned screw and overlapping slots similar to that described for the female inner conductor coupling 48. Also, similar to the female inner conductor coupling 48, the male conductor coupling's threaded portion 92 is used to secure the inner conductor coupling 86 to the helical ribbed inner conductor of the coaxial cable 85.

As illustrated in FIGS. 6*a* and 6*b*, the male and female connectors 13 and 64 are physically held or "locked" together and electrically connected, in part, by the canted-coil spring 11 residing in the channel formed by the circumferential grooves 44 and 80 on the interior surface 38 of the female outer conductor coupling 30 and the exterior surface 72 of the male outer conductor coupling 66 when the female and male connectors 13 and 64 are in a connected state. This "locking" of the male and female connectors occurs because the free position diameter D of the spring 11 is larger than either groove 44 and 80. Consequently, the spring 11, once it is in the channel, must be deformed sufficiently to allow the two grooves 44 and 80 to move substantially relative to each other. As will be appreciated by those skilled in the art, there will always be varying tensile forces existing on the cables wherein some compressive forces are generated on the spring 11 by contact with the grooves 44 and 80. These ordinary tensile and compressive forces will cause some deformation of spring 11. However, spring 11 resists deformation in proportion to the spring constant of the spring 11 and unless the tensile and compressive forces are sufficient to overcome the spring constant and cause deformation of the spring in the amount d, the connectors will not separate.

FIGS. 7*a* and 7*b* illustrate the condition where there has been sufficient deformation of the canted-coil spring 11 to a loaded position diameter represented by D-d. As will be appreciated by those skilled in the art, the degree of tensile force required to separate the connectors 13 and 64 can be controlled by varying the size and shape of the grooves 44 and 80, the diameter and size of the spring 11, and/or the spring constant.

In another contemplated embodiment of the present invention, multiple circumferential grooves and canted-coil springs may be used to hold or lock the two connectors 13 and 64 together, as well as, to provide primary electrical contact between the two connectors 13 and 64. The grooves may be distributed along the exterior and interior surfaces of the male and female outer conductor couplings 66 and 30 so as to form corresponding channels in which canted-coil springs may reside.

Although the present invention has been described with respect to one or more particular embodiments of the apparatus, it will be understood that other embodiments of the present invention may be made without departing from the spirit and scope of the present invention. Hence, the present invention is deemed limited only by the appended claims and the reasonable interpretation thereof.

What is claimed is:

1. An apparatus for connecting an outer and inner conductor of a first radio frequency coaxial cable to an outer and inner conductor of a second radio frequency cable, the apparatus comprising:

a female outer conductor coupling, wherein the female outer conductor coupling includes a first end, a second end, an exterior surface and an interior surface, wherein the interior surface includes a first circumferential groove positioned near the first end and a second circumferential groove positioned between the first circumferential groove and the first end;

a means for securing the second end of the female outer conductor coupling to the outer conductor of the first radio frequency cable;

a male outer conductor coupling, wherein the male outer conductor coupling includes a first end, a second end, an exterior surface and an interior surface, wherein the exterior surface includes a circumferential groove positioned near the first end so as to be aligned with the circumferential groove on the interior surface of the female outer conductor coupling to form a substantially enclosed channel when the female and male outer conductor couplings are in a connected state;

a means for securing the second end of the male outer conductor coupling to the outer conductor of the second radio frequency cable;

a means for connecting the inner conductor of the first radio frequency coaxial cable to the inner conductor of the second radio frequency conductor;

a canter-coil spring, wherein the canted-coil spring is positioned in the channel formed by the first circumferential groove of the interior surface of the female outer conductor coupling and the circumferential groove in the exterior surface of the male outer conductor coupling when the female and male outer conductor couplings are in a connected state; and an O-ring positioned within the second circumferential groove in the interior surface of the female outer conductor coupling.

2. The apparatus of claim 1 wherein the interior surface of the female outer conductor coupling further includes a second circumferential groove positioned between the circumferential groove and the first end; and an O-ting positioned within the second circumferential groove.

3. An apparatus for connecting a non-helical ribbed outer conductor and a helical ribbed inner conductor of a first radio frequency coaxial cable to a ribbed outer conductor and a helical ribbed inner conductor of a second radio frequency coaxial cable, the apparatus comprising:

a female connector further comprising:

a first split ferrule, the first ferule further comprising a semi-circular first half and a semi-circular second half, wherein both the first and second semi-circular halves include an interior surface substantially matching the shape of the non-helical ribbed outer conductor of the first radio frequency coaxial cable, a beveled first end, and an outwardly extending ranged second end, a means for holding the semi-circular first and second halves of the first split ferrule adjacent to the non-helical ribbed outer conductor of the first radio frequency coaxial cable, a female outer conductor coupling, wherein the female conductor coupling includes a first end, a second end, an exterior surface and an interior surface, wherein the interior surface includes an interior flange adjacent to its first end, a beveled interior projection adjacent to the second end, and a circumferential groove positioned between the interior flange and the first end, and wherein the exterior surface includes a threaded portion adjacent to the second end, a female inner conductor coupling having a tubular first end and a second end, wherein its second end includes means for connecting to the helical ribbed inner conductor of the first coaxial cable, a first union nut, the first union nut including a first end, a second end, and an interior surface having an inwardly extending flange and a threaded portion adjacent to its first end, whereby the second end of the female outer conductor coupling is secured to the first radio frequency cable's outer conductor by joining the threads of the union nut with the threads of the outer conductor coupling while the inwardly extending flange of the union nut is positioned adjacent to ranged second end of the split ferrule and the beveled interior projection of the female outer conductor coupling is positioned adjacent to the beveled first end of the first split ferrule;

a male connector further comprising:

a second split ferrule, the second ferule further comprising a semi-circular first half and a semi-circular second half, wherein both the first and second semi-circular halves include an interior surface substantially matching the shape of the non-helical ribbed outer conductor of the second radio frequency coaxial cable, a beveled first end, an outwardly extending ranged second end, a means for holding the semi-circular first and second halves of the second split ferrule adjacent to the non-helical ribbed outer conductor of the second radio frequency coaxial cable, a male outer conductor coupling, wherein the male outer conductor coupling includes a first end, a second end, an exterior surface and an interior surface, wherein the interior surface includes a beveled interior projection adjacent to its second end, and wherein the exterior surface includes an exterior flange adjacent to the first end, a circumferential groove positioned between the exterior flange and the first end, and a threaded portion adjacent to the second end, and wherein the circumferential groove is positioned so as to be aligned with the circumferential groove on the interior surface of the female outer conductor coupling to form a substantially enclosed channel when the female and male outer conductor couplings are in a connected state;

a male inner conductor coupling having a tubular first end and a second end, wherein its second end includes means for connecting the male inner conductor coupling to the helical ribbed inner conductor of the second coaxial cable, a second union nut, the second union nut including a first end, a second end, and an interior surface having an inwardly extending flange and a threaded portion adjacent to its first end, whereby the second end of the male outer conductor coupling is secured to the second radio frequency cable's outer conductor by joining the threads of the union nut with the threads of the outer conductor coupling while the inwardly extending flange of the union nut is positioned adjacent to ranged second end of the split ferrule and the beveled interior projection of the male outer conductor coupling is positioned adjacent to the beveled first end of the second split ferrule; and a canted-coil spring, wherein the canted-coil spring is positioned between the channel formed by the circumferential grooves of the interior surface of the female outer conductor coupling and the exterior surface of the male outer conductor coupling when the female and male connectors are in a connected state.

4. The apparatus of claim 3 wherein the tubular first end of the male inner conductor further includes a plurality of co-axial slots.

* * * * *

UNITED STATES PATENT AND TRADEMARK OFFICE

CERTIFICATE OF CORRECTION

PATENT NO. : 5,454,735
DATED : October 3, 1995
INVENTOR(S) : James W. Nelson

It is certified that error appears in the above-indentified patent and that said Letters Patent is hereby corrected as shown below:

Title page, item [56], References Cited, "3,297,895" should read --3,291,895--.

Claim 2, column 5, line 46 "claim 1" should read -- claim 3--

Claim 2, column 5, line 5 "an O-ting" should read -- an O-ring --

Claim 3, column 6, line 27 "ranged second" should read -- flanged second --

Claim 3, column 6, line 41 "extending ranged" should read -- extending flanged --

Signed and Sealed this

Twentieth Day of February, 1996

*Attest:*

*Attesting Officer*

Bruce Lehman

BRUCE LEHMAN

*Commissioner of Patents and Trademarks*